US011757165B2

(12) United States Patent
Shi

(10) Patent No.: US 11,757,165 B2
(45) **Date of Patent: *Sep. 12, 2023**

(54) FOLDED WAVEGUIDE FOR ANTENNA

(71) Applicant: Aptiv Technologies Limited, St. Michael (BB)

(72) Inventor: Shawn Shi, Thousand Oaks, CA (US)

(73) Assignee: Aptiv Technologies Limited, St. Michael (BB)

( * ) Notice: Subject to any disclaimer, the term of this patent is extended or adjusted under 35 U.S.C. 154(b) by 0 days.

This patent is subject to a terminal disclaimer.

(21) Appl. No.: 17/812,867

(22) Filed: Jul. 15, 2022

(65) Prior Publication Data

US 2022/0352616 A1 Nov. 3, 2022

Related U.S. Application Data

(63) Continuation of application No. 17/131,534, filed on Dec. 22, 2020, now Pat. No. 11,444,364.

(51) Int. Cl.
*H01Q 13/22* (2006.01)
*H01P 3/12* (2006.01)
(Continued)

(52) U.S. Cl.
CPC ..... *H01P 3/123* (2013.01); *H01Q 1/3233* (2013.01); *H01Q 13/22* (2013.01)

(58) Field of Classification Search
CPC .... H01P 3/12; H01P 3/123; H01P 5/10; H01P 5/107; H01Q 1/3233; H01Q 13/10;
(Continued)

(56) References Cited

U.S. PATENT DOCUMENTS 2,851,686 A 9/1958 Hagaman
3,029,432 A 4/1962 Hansen
(Continued)

FOREIGN PATENT DOCUMENTS

CA 2654470 A1 12/2007
CN 1254446 A 5/2000
(Continued)

OTHER PUBLICATIONS

"Extended European Search Report", EP Application No. 21211165.2, dated May 13, 2022, 12 pages.
(Continued)

*Primary Examiner* — Tho G Phan
(74) *Attorney, Agent, or Firm* — Sawtooth Patent Group PLLC

(57) ABSTRACT

This document describes a folded waveguide for antenna. The folded waveguide may be an air waveguide and includes a hollow core that forms a rectangular opening in a longitudinal direction at one end, a closed wall at an opposite end, and a sinusoidal shape that folds back and forth about a longitudinal axis that runs in the longitudinal direction through the hollow core. The hollow core forms a plurality of radiation slots, each including a hole through one of multiple surfaces that defines the hollow core. The radiation slots are arranged on the one surface to produce a particular antenna pattern. The radiation slots and sinusoidal shape enable the folded waveguide to prevent grating lobes from appearing in the particular antenna pattern on either side of a horizontal-polarity, main beam, or to prevent X-band lobes from appearing in the particular antenna pattern on either side of a vertical-polarity, main beam.

20 Claims, 11 Drawing Sheets

(51) Int. Cl.
*H01P 3/123* (2006.01)
*H01Q 1/32* (2006.01)

(58) Field of Classification Search
CPC ..... H01Q 13/12; H01Q 13/16; H01Q 13/18; H01Q 13/22; H01Q 21/00; H01Q 21/005
See application file for complete search history.

(56) References Cited

U.S. PATENT DOCUMENTS 3,328,800 A 6/1967 Algeo
3,462,713 A 8/1969 Knerr
3,473,162 A 10/1969 Veith
3,579,149 A 5/1971 Ramsey
3,594,806 A 7/1971 Black et al.
3,852,689 A 12/1974 Watson
4,157,516 A 6/1979 Grijp
4,453,142 A 6/1984 Murphy
4,562,416 A 12/1985 Sedivec
4,590,480 A 5/1986 Nikolayuk et al.
4,839,663 A 6/1989 Kurtz
5,030,965 A 7/1991 Park et al.
5,065,123 A 11/1991 Heckaman et al.
5,068,670 A 11/1991 Maoz
5,113,197 A 5/1992 Luh
5,337,065 A 8/1994 Bonnet et al.
5,350,499 A 9/1994 Shibaike et al.
5,541,612 A 7/1996 Josefsson
5,638,079 A * 6/1997 Kastner ..... H01Q 21/005 343/768
5,923,225 A 7/1999 Santos
5,982,256 A 11/1999 Uchimura et al.
5,986,527 A 11/1999 Ishikawa et al.
6,072,375 A 6/2000 Adkins et al.
6,166,701 A 12/2000 Park et al.
6,414,573 B1 7/2002 Swineford et al.
6,489,855 B1 12/2002 Kitamori et al.
6,535,083 B1 3/2003 Hageman et al.
6,622,370 B1 9/2003 Sherman et al.
6,788,918 B2 9/2004 Saitoh et al.
6,794,950 B2 9/2004 Toit et al.
6,859,114 B2 2/2005 Eleftheriades et al.
6,867,660 B2 3/2005 Kitamori et al.
6,958,662 B1 10/2005 Salmela et al.
7,091,919 B2 8/2006 Bannon
7,142,165 B2 11/2006 Sanchez et al.
7,420,442 B1 9/2008 Forman
7,439,822 B2 10/2008 Shimura et al.
7,495,532 B2 2/2009 McKinzie, III
7,498,994 B2 3/2009 Vacanti
7,626,476 B2 12/2009 Kim et al.
7,659,799 B2 2/2010 Jun et al.
7,886,434 B1 2/2011 Forman
7,973,616 B2 7/2011 Shijo et al.
7,994,879 B2 8/2011 Kim et al.
8,013,694 B2 9/2011 Hiramatsu et al.
8,089,327 B2 1/2012 Margomenos et al.
8,159,316 B2 4/2012 Miyazato et al.
8,395,552 B2 3/2013 Geiler et al.
8,451,175 B2 5/2013 Gummalla et al.
8,451,189 B1 5/2013 Fluhler
8,604,990 B1 * 12/2013 Chen ..... H01Q 21/0043 343/771
8,692,731 B2 4/2014 Lee et al.
8,717,124 B2 5/2014 Vanhille et al.
8,803,638 B2 8/2014 Kildal
8,948,562 B2 2/2015 Norris et al.
9,007,269 B2 4/2015 Lee et al.
9,203,155 B2 12/2015 Choi et al.
9,246,204 B1 1/2016 Kabakian
9,258,884 B2 2/2016 Saito
9,356,238 B2 5/2016 Norris et al.
9,368,878 B2 6/2016 Chen et al.
9,450,281 B2 9/2016 Kim
9,537,212 B2 1/2017 Rosen et al.
9,647,313 B2 5/2017 Marconi et al.
9,653,773 B2 5/2017 Ferrari et al.
9,653,819 B1 5/2017 Izadian
9,673,532 B2 6/2017 Cheng et al.
9,806,393 B2 10/2017 Kildal et al.
9,806,431 B1 10/2017 Izadian
9,813,042 B2 11/2017 Xue et al.
9,843,301 B1 12/2017 Rodgers et al.
9,935,065 B1 4/2018 Baheti et al.
9,991,606 B2 6/2018 Kirino et al.
9,997,842 B2 6/2018 Kirino et al.
10,027,032 B2 7/2018 Kirino et al.
10,042,045 B2 8/2018 Kirino et al.
10,090,600 B2 10/2018 Kirino et al.
10,114,067 B2 10/2018 Lam et al.
10,153,533 B2 12/2018 Kirino
10,158,158 B2 12/2018 Kirino et al.
10,164,318 B2 12/2018 Seok et al.
10,164,344 B2 12/2018 Kirino et al.
10,218,078 B2 2/2019 Kirino et al.
10,230,173 B2 3/2019 Kirino et al.
10,263,310 B2 4/2019 Kildal et al.
10,283,832 B1 5/2019 Chayat et al.
10,312,596 B2 6/2019 Gregoire
10,320,083 B2 6/2019 Kirino et al.
10,333,227 B2 6/2019 Kirino et al.
10,374,323 B2 8/2019 Kamo et al.
10,381,317 B2 8/2019 Maaskant et al.
10,381,741 B2 8/2019 Kirino et al.
10,439,298 B2 10/2019 Kirino et al.
10,468,736 B2 11/2019 Mangaiahgari
10,505,282 B2 12/2019 Lilja
10,534,061 B2 1/2020 Vassilev et al.
10,559,889 B2 2/2020 Kirino et al.
10,594,045 B2 3/2020 Kirino et al.
10,601,144 B2 3/2020 Kamo et al.
10,608,345 B2 3/2020 Kirino et al.
10,622,696 B2 4/2020 Kamo et al.
10,627,502 B2 4/2020 Kirino et al.
10,651,138 B2 5/2020 Kirino et al.
10,651,567 B2 5/2020 Kamo et al.
10,658,760 B2 5/2020 Kamo et al.
10,670,810 B2 6/2020 Sakr et al.
10,705,294 B2 7/2020 Guerber et al.
10,707,584 B2 7/2020 Kirino et al.
10,714,802 B2 7/2020 Kirino et al.
10,727,561 B2 7/2020 Kirino et al.
10,727,611 B2 7/2020 Kirino et al.
10,763,590 B2 9/2020 Kirino et al.
10,763,591 B2 9/2020 Kirino et al.
10,775,573 B1 9/2020 Hsu et al.
10,811,373 B2 10/2020 Zaman et al.
10,826,147 B2 11/2020 Sikina et al.
10,833,382 B2 11/2020 Sysouphat
10,833,385 B2 11/2020 Mangaiahgari
10,892,536 B2 1/2021 Fan et al.
10,957,971 B2 3/2021 Doyle et al.
10,957,988 B2 3/2021 Kirino et al.
10,971,824 B2 4/2021 Baumgartner et al.
10,983,194 B1 4/2021 Patel et al.
10,985,434 B2 4/2021 Wagner et al.
10,992,056 B2 4/2021 Kamo et al.
11,061,110 B2 7/2021 Kamo et al.
11,088,432 B2 8/2021 Seok et al.
11,088,464 B2 8/2021 Sato et al.
11,114,733 B2 9/2021 Doyle et al.
11,121,475 B2 9/2021 Yang et al.
11,169,325 B2 11/2021 Guerber et al.
11,171,399 B2 11/2021 Alexanian et al.
11,196,171 B2 12/2021 Doyle et al.
11,201,414 B2 12/2021 Doyle et al.
11,249,011 B2 2/2022 Challener
11,283,162 B2 3/2022 Doyle et al.
11,289,787 B2 3/2022 Yang
11,349,183 B2 5/2022 Rahiminejad et al.
11,349,220 B2 5/2022 Alexanian et al.
11,378,683 B2 7/2022 Alexanian et al.
11,411,292 B2 8/2022 Kirino
11,444,364 B2 * 9/2022 Shi ..... H01P 3/123

(56) References Cited

U.S. PATENT DOCUMENTS

| | | | | |
|---|---|---|---|---|
| 11,495,871 | B2 | 11/2022 | Vosoogh et al. | |
| 11,563,259 | B2 | 1/2023 | Alexanian et al. | |
| 11,611,138 | B2 | 3/2023 | Ogawa et al. | |
| 11,626,652 | B2 | 4/2023 | Vilenskiy et al. | |
| 2002/0021197 | A1 | 2/2002 | Elco | |
| 2004/0069984 | A1 | 4/2004 | Estes et al. | |
| 2004/0090290 | A1 | 5/2004 | Teshirogi et al. | |
| 2004/0174315 | A1 | 9/2004 | Miyata | |
| 2005/0146474 | A1 | 7/2005 | Bannon | |
| 2005/0237253 | A1* | 10/2005 | Kuo | H01Q 13/02 343/786 |
| 2006/0038724 | A1 | 2/2006 | Tikhov et al. | |
| 2006/0113598 | A1 | 6/2006 | Chen et al. | |
| 2006/0158382 | A1 | 7/2006 | Nagai | |
| 2007/0013598 | A1* | 1/2007 | Artis | H01Q 21/005 343/772 |
| 2008/0129409 | A1 | 6/2008 | Nagaishi et al. | |
| 2008/0150821 | A1 | 6/2008 | Koch et al. | |
| 2009/0040132 | A1 | 2/2009 | Sridhar et al. | |
| 2009/0207090 | A1 | 8/2009 | Pettus et al. | |
| 2009/0243762 | A1 | 10/2009 | Chen et al. | |
| 2009/0300901 | A1 | 12/2009 | Artis et al. | |
| 2010/0134376 | A1 | 6/2010 | Margomenos et al. | |
| 2010/0321265 | A1 | 12/2010 | Yamaguchi et al. | |
| 2012/0013421 | A1 | 1/2012 | Hayata | |
| 2012/0050125 | A1 | 3/2012 | Leiba et al. | |
| 2012/0068316 | A1 | 3/2012 | Ligander | |
| 2012/0163811 | A1 | 6/2012 | Doany et al. | |
| 2012/0242421 | A1 | 9/2012 | Robin et al. | |
| 2012/0256796 | A1 | 10/2012 | Leiba | |
| 2013/0057358 | A1 | 3/2013 | Anthony et al. | |
| 2014/0015709 | A1 | 1/2014 | Shijo et al. | |
| 2014/0091884 | A1 | 4/2014 | Flatters | |
| 2014/0106684 | A1 | 4/2014 | Burns et al. | |
| 2015/0097633 | A1 | 4/2015 | Devries et al. | |
| 2015/0229017 | A1 | 8/2015 | Suzuki et al. | |
| 2015/0229027 | A1 | 8/2015 | Sonozaki et al. | |
| 2015/0263429 | A1 | 9/2015 | Vahidpour et al. | |
| 2015/0357698 | A1 | 12/2015 | Kushta | |
| 2015/0364804 | A1 | 12/2015 | Tong et al. | |
| 2015/0364830 | A1 | 12/2015 | Tong et al. | |
| 2016/0043455 | A1 | 2/2016 | Seler et al. | |
| 2016/0049714 | A1 | 2/2016 | Ligander et al. | |
| 2016/0118705 | A1 | 4/2016 | Tang et al. | |
| 2016/0126637 | A1 | 5/2016 | Uemichi | |
| 2016/0204495 | A1 | 7/2016 | Takeda et al. | |
| 2016/0276727 | A1 | 9/2016 | Dang et al. | |
| 2016/0293557 | A1 | 10/2016 | Topak et al. | |
| 2016/0301125 | A1 | 10/2016 | Kim et al. | |
| 2017/0003377 | A1 | 1/2017 | Menge | |
| 2017/0084554 | A1 | 3/2017 | Dogiamis et al. | |
| 2017/0294719 | A1 | 10/2017 | Tatomir | |
| 2017/0324135 | A1 | 11/2017 | Blech et al. | |
| 2018/0131084 | A1 | 5/2018 | Park et al. | |
| 2018/0226709 | A1 | 8/2018 | Mangaiahgari | |
| 2018/0233465 | A1 | 8/2018 | Spella et al. | |
| 2018/0284186 | A1 | 10/2018 | Chadha et al. | |
| 2018/0301819 | A1 | 10/2018 | Kirino et al. | |
| 2018/0343711 | A1 | 11/2018 | Wixforth et al. | |
| 2018/0351261 | A1 | 12/2018 | Kamo et al. | |
| 2018/0375185 | A1 | 12/2018 | Kirino et al. | |
| 2019/0006743 | A1 | 1/2019 | Kirino et al. | |
| 2019/0013563 | A1 | 1/2019 | Takeda et al. | |
| 2019/0245276 | A1 | 8/2019 | Li et al. | |
| 2019/0252778 | A1 | 8/2019 | Duan | |
| 2019/0324134 | A1 | 10/2019 | Cattle | |
| 2020/0021001 | A1 | 1/2020 | Mangaiahgari | |
| 2020/0044360 | A1 | 2/2020 | Kamo et al. | |
| 2020/0059002 | A1 | 2/2020 | Renard et al. | |
| 2020/0166637 | A1 | 5/2020 | Hess et al. | |
| 2020/0203849 | A1 | 6/2020 | Lim et al. | |
| 2020/0212594 | A1 | 7/2020 | Kirino et al. | |
| 2020/0235453 | A1 | 7/2020 | Lang | |
| 2020/0319293 | A1 | 10/2020 | Kuriyama et al. | |
| 2020/0343612 | A1 | 10/2020 | Shi | |
| 2020/0373678 | A1 | 11/2020 | Park et al. | |
| 2021/0028528 | A1 | 1/2021 | Alexanian et al. | |
| 2021/0036393 | A1 | 2/2021 | Mangaiahgari | |
| 2021/0159577 | A1 | 5/2021 | Carlred et al. | |
| 2021/0249777 | A1 | 8/2021 | Alexanian et al. | |
| 2021/0305667 | A1 | 9/2021 | Bencivenni | |
| 2022/0094071 | A1 | 3/2022 | Doyle et al. | |
| 2022/0109246 | A1 | 4/2022 | Emanuelsson et al. | |

FOREIGN PATENT DOCUMENTS

| | | | | |
|---|---|---|---|---|
| CN | 1620738 | A | 5/2005 | |
| CN | 2796131 | | 7/2006 | |
| CN | 201383535 | | 1/2010 | |
| CN | 102157787 | A | 8/2011 | |
| CN | 102420352 | A | 4/2012 | |
| CN | 103326125 | A | 9/2013 | |
| CN | 103515682 | A | 1/2014 | |
| CN | 104900956 | A | 9/2015 | |
| CN | 104993254 | A | 10/2015 | |
| CN | 105609909 | A | 5/2016 | |
| CN | 105680133 | A | 6/2016 | |
| CN | 105958167 | A | 9/2016 | |
| CN | 108258392 | A | 7/2018 | |
| CN | 109643856 | A | 4/2019 | |
| CN | 109980361 | A | 7/2019 | |
| CN | 209389219 | U | 9/2019 | |
| DE | 112017006415 | | 9/2019 | |
| DE | 102019200893 | A1 | 7/2020 | |
| EP | 0818058 | A1 | 1/1998 | |
| EP | 2500978 | A1 | 9/2012 | |
| EP | 2843758 | A1 | 3/2015 | |
| EP | 3460903 | A1 | 3/2019 | |
| EP | 4089840 | A1 * | 11/2022 | H01P 11/002 |
| GB | 893008 | A | 4/1962 | |
| GB | 2463711 | A | 3/2010 | |
| GB | 2489950 | A | 10/2012 | |
| JP | 2000183222 | A | 6/2000 | |
| JP | 2003198242 | A | 7/2003 | |
| JP | 2003289201 | A | 10/2003 | |
| JP | 2013187752 | A | 9/2013 | |
| KR | 20080044752 | A | 5/2008 | |
| KR | 1020080044752 | A | 5/2008 | |
| KR | 20080105396 | A | 12/2008 | |
| WO | 9934477 | A1 | 7/1999 | |
| WO | 2013189513 | A1 | 12/2013 | |
| WO | 2018003932 | A1 | 1/2018 | |
| WO | 2018052335 | A1 | 3/2018 | |
| WO | 2019085368 | A1 | 5/2019 | |

OTHER PUBLICATIONS

"Extended European Search Report", EP Application No. 21211167.8, dated May 19, 2022, 10 pages.

"Extended European Search Report", EP Application No. 21211168.6, dated May 13, 2022, 11 pages.

"Extended European Search Report", EP Application No. 21211452.4, dated May 16, 2022, 10 pages.

"Extended European Search Report", EP Application No. 21211478.9, dated May 19, 2022, 10 pages.

"Extended European Search Report", EP Application No. 21216319.0, dated Jun. 10, 2022, 12 pages.

"Extended European Search Report", EP Application No. 22166998.9, dated Sep. 9, 2022, 12 pages.

"WR-90 Waveguides", Pasternack Enterprises, Inc., 2016, Retrieved from https://web.archive.org/web/20160308205114/http://www.pasternack.com:80/wr-90-waveguides-category.aspx, 2 pages.

Adams, et al., "Dual Band Frequency Scanned, Height Finder Antenna", 1991 21st European Microwave Conference, 1991, 6 pages.

Alhuwaimel, et al., "Performance Enhancement of a Slotted Waveguide Antenna by Utilizing Parasitic Elements", Sep. 7, 2015, pp. 1303-1306.

Gray, et al., "Carbon Fibre Reinforced Plastic Slotted Waveguide Antenna", Proceedings of Asia-Pacific Microwave Conference 2010, pp. 307-310.

Hausman, "Termination Insensitive Mixers", 2011 IEEE International Conference on Microwaves, Communications, Antennas and Electronic Systems (COMCAS 2011), Nov. 7, 2011, 13 pages.

(56) References Cited

OTHER PUBLICATIONS

Li, et al., "Millimetre-wave slotted array antenna based on double-layer substrate integrated waveguide", Jun. 1, 2015, pp. 882-888.
Mak, et al., "A Magnetoelectric Dipole Leaky-Wave Antenna for Millimeter-Wave Application", Dec. 12, 2017, pp. 6395-6402.
Mallahzadeh, et al., "A Low Cross-Polarization Slotted Ridged SIW Array Antenna Design With Mutual Coupling Considerations", Jul. 17, 2015, pp. 4324-4333.
Rossello, et al., "Substrate Integrated Waveguide Aperture Coupled Patch Antenna Array for 24 GHz Wireless Backhaul and Radar Applications", Nov. 16, 2014, 2 pages.
Shehab, et al., "Substrate-Integrated-Waveguide Power Dividers", Oct. 15, 2019, pp. 27-38.
Wu, et al., "A Planar W-Band Large-Scale High-Gain Substrate-Integrated Waveguide Slot Array", Feb. 3, 2020, pp. 6429-6434.
Xu, et al., "CPW Center-Fed Single-Layer SIW Slot Antenna Array for Automotive Radars", Jun. 12, 2014, pp. 4528-4536.
Yu, et al., "Optimization and Implementation of SIW Slot Array for Both Medium- and Long-Range 77 GHz Automotive Radar Application", IEEE Transactions on Antennas and Propagation, vol. 66, No. 7, Jul. 2018, pp. 3769-3774.
"Extended European Search Report", EP Application No. 18153137.7, dated Jun. 15, 2018, 8 pages.
"Extended European Search Report", EP Application No. 20166797, dated Sep. 16, 2020, 11 pages.
"Extended European Search Report", EP Application No. 21211474.8, dated Apr. 20, 2022, 14 pages.
"Foreign Office Action", CN Application No. 201810122408.4, dated Jun. 2, 2021, 15 pages.
"Foreign Office Action", CN Application No. 201810122408.4, dated Oct. 18, 2021, 19 pages.
Jankovic, et al., "Stepped Bend Substrate Integrated Waveguide to Rectangular Waveguide Transitions", Jun. 2016, 2 pages.
Wang, et al., "Low-loss frequency scanning planar array with hybrid feeding structure for low-altitude detection radar", Sep. 13, 2019, pp. 6708-6711.
Wang, et al., "Mechanical and Dielectric Strength of Laminated Epoxy Dielectric Graded Materials", Mar. 2020, 15 pages.
"Foreign Office Action", CN Application No. 202111551878.0, dated Jun. 15, 2023, 20 pages.
"Foreign Office Action", CN Application No. 202111563233.9, dated May 31, 2023, 15 pages.

* cited by examiner

FOLDED WAVEGUIDE FOR ANTENNA

CROSS-REFERENCE TO RELATED APPLICATION

This application is a continuation of U.S. patent application Ser. No. 17/131,534, filed Dec. 22, 2020, the entire disclosure of which is hereby incorporated herein by reference.

BACKGROUND

Some devices (e.g., radar) use electromagnetic signals to detect and track objects. The electromagnetic signals are transmitted and received using one or more antennas. An antenna may be characterized in terms of gain, beam width, or, more specifically, in terms of the antenna pattern, which is a measure of the antenna gain as a function of direction. Certain applications may benefit from precisely controlling the antenna pattern. A waveguide may be used to improve these antenna characteristics. The waveguide can include perforations that improve an antenna pattern by leaking some of the electromagnetic radiation that is directed towards the antenna. However, these waveguides cannot prevent grating lobes on either side of a horizontal-polarity main beam, nor can they prevent X-band lobes on either side of a vertical-polarity main beam.

SUMMARY

This document describes techniques, apparatuses, and systems utilizing a folded waveguide for antenna. The folded waveguide may be an air waveguide and is referred to throughout this document as simply a waveguide for short. The described waveguide includes a hollow core. The hollow core forms a rectangular opening in a longitudinal direction at one end, a closed wall at an opposite end, and a sinusoidal shape that folds back and forth about a longitudinal axis that runs in the longitudinal direction through the hollow core. The hollow core further forms a plurality of radiation slots, each of the radiation slots including a hole through one of multiple surfaces of the folded waveguide that defines the hollow core. The plurality of radiation slots is arranged on the one of the multiple surfaces to produce a particular antenna pattern at an antenna element when the antenna element is electrically coupled to the opposite end of the hollow core.

This Summary introduces simplified concepts related to a folded waveguide antenna, which are further described below in the Detailed Description and Drawings. This Summary is not intended to identify essential features of the claimed subject matter, nor is it intended for use in determining the scope of the claimed subject matter.

BRIEF DESCRIPTION OF THE DRAWINGS

The details of techniques, apparatuses, and systems utilizing a folded waveguide for antenna are described in this document with reference to the following figures. The same numbers are often used throughout the drawings to reference like features and components:

FIG. 2-1 illustrates an example folded waveguide for antenna, in accordance with techniques, apparatuses, and systems of this disclosure;

FIG. 2-2 illustrates an antenna pattern associated with the example folded waveguide for antenna shown in FIG. 2-1;

FIG. 2-3 illustrates an antenna pattern without the example folded waveguide for antenna shown in FIG. 2-1;

FIG. 3-1 illustrates another example folded waveguide for antenna, in accordance with techniques, apparatuses, and systems of this disclosure;

FIG. 3-2 illustrates an antenna pattern associated with the example folded waveguide for antenna shown in FIG. 3-1;

FIG. 3-3 illustrates an antenna pattern without the example folded waveguide for antenna shown in FIG. 3-1;

FIG. 4-1 illustrates another example folded waveguide for antenna, in accordance with techniques, apparatuses, and systems of this disclosure;

FIG. 4-2 illustrates an antenna pattern associated with the example folded waveguide for antenna shown in FIG. 4-1.

DETAILED DESCRIPTION

Overview

Radar systems are an important sensing technology used in many industries, including the automotive industry, to acquire information about the surrounding environment. An antenna is used in radar systems to transmit and receive electromagnetic (EM) energy or signals. Some radar systems use multiple antenna elements in an array to provide increased gain and directivity over what can be achieved using a single antenna element. In reception, signals from the individual elements are combined with appropriate phases and weighted amplitudes to provide the desired antenna reception pattern. Antenna arrays are also used in transmission, splitting signal power amongst the elements, using appropriate phases and weighted amplitudes to provide the desired antenna transmission pattern. A waveguide can be used to transfer EM energy to and from the antenna elements. Further, waveguides can be arranged to provide the desired phasing, combining, or splitting of signals and energy.

In contrast, this document describes techniques, apparatuses, and systems utilizing a folded waveguide for antenna. The folded waveguide may be an air waveguide and includes a hollow core that forms a rectangular opening in a longitudinal direction at one end, a closed wall at an opposite end, and a sinusoidal shape that folds back and forth about a longitudinal axis that runs in the longitudinal direction through the hollow core. The hollow core forms a plurality of radiation slots, each including a hole through one of multiple surfaces that defines the hollow core. The radiation slots are arranged on the one surface to produce a particular antenna pattern. The radiation slots and sinusoidal shape enable the folded waveguide to prevent grating lobes from appearing in the particular antenna pattern on either side of a horizontal-polarity main beam, or to prevent X-band lobes from appearing in the particular antenna pattern on either side of a vertical-polarity main beam.

This is just one example of the described techniques, apparatuses, and systems of a folded waveguide for antenna. This document describes other examples and implementations.

Example System

Figure 1:
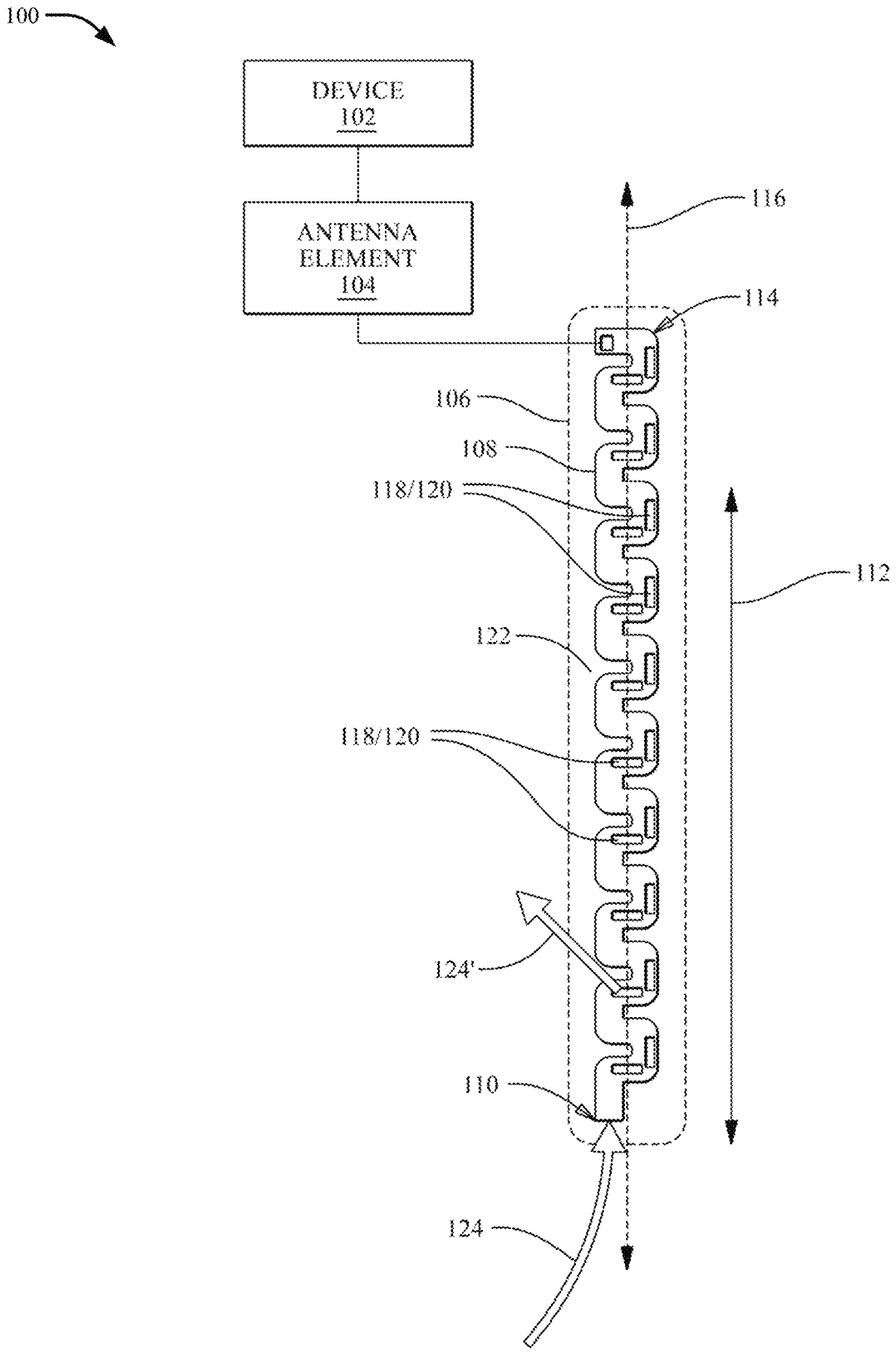
FIG. 1 illustrates an example system that includes a folded waveguide for antenna, in accordance with techniques, apparatuses, and systems of this disclosure.

FIG. 1 illustrates an example system 100 that includes a folded waveguide for antenna, in accordance with techniques, apparatuses, and systems of this disclosure. The system includes a device 102, an antenna 104, and a waveguide 106. The system 100 may be part of a vehicle, such as a self-driving automobile. Portions of the system 100 may be integrated onto a printed circuit board or substrate.

The device 102 is configured to receive and process signals to perform a function. The device 102 may be a radar device, an ultrasound device, or other device configured to receive electromagnetic signals. An input to the device 102 is operatively coupled to the antenna 104.

The antenna 104 is configured to capture electromagnetic signals 124 and channel them to the device 102. The antenna 104 and the device 102 may be coupled via wired or wireless links. These links carry electromagnetic signals 124 from the antenna 104 to the device 102.

The waveguide 106 is a folded waveguide and configured to channel electromagnetic signals 124 being transmitted through air to the antenna 104 and the device 102. The waveguide 106 includes a hollow core 108. The folded waveguide 106 may include metal. The folded waveguide 106 may include plastic. A combination of plastic and metal may be used to form the waveguide 106. In FIG. 1, the waveguide 106 is viewed from above. A top surface 122 is visible, which is one of multiple surfaces of the waveguide 106 that forms the hollow core 108.

The hollow core 108 forms a rectangular opening 110 in a longitudinal direction 112 at one end and a closed wall 114 at an opposite end. This opposite end with the closed wall 114 is operatively coupled to the antenna 104. Electromagnetic signals enter the waveguide 106 through the opening 110, and some signals exit the waveguide 106 at the opposite end and to the antenna 104. The hollow core 108 forms a sinusoidal shape that folds back and forth about a longitudinal axis 116 that runs in the longitudinal direction 112 through the hollow core 108.

The hollow core 108 also forms a plurality of radiation slots 118. Each of the radiation slots 118 includes a respective hole 120 through one surface 122 of the multiple surfaces of the folded waveguide 106 that defines the hollow core 108. For example, the top surface 122 of the waveguide 106 may include radiation slots 118 similar to those shown in FIG. 1. The plurality of radiation slots 118 are arranged on the surface 122 to produce a particular antenna pattern for the device 102 and the antenna 104 that is electrically coupled to the opposite end of the hollow core 108.

As shown in FIG. 1, the plurality of radiation slots 118 are configured to dissipate, from the hollow core 108, a portion 124' of electromagnetic radiation 124 that enters the rectangular opening 110 before that portion 124' of the electromagnetic radiation 124 can reach the antenna 104 that is electrically coupled to the opposite end of the hollow core 108. In other words, the electromagnetic radiation is allowed to leak out the radiation slots 118 on its way through the hollow core 108 in the longitudinal direction 112. Each of the plurality of radiation slots 118 is sized and positioned on one of the multiple surfaces to produce the particular antenna pattern at the antenna 104 that is electrically coupled to the opposite end of the hollow core 108.

Example Apparatus

Figure 2:
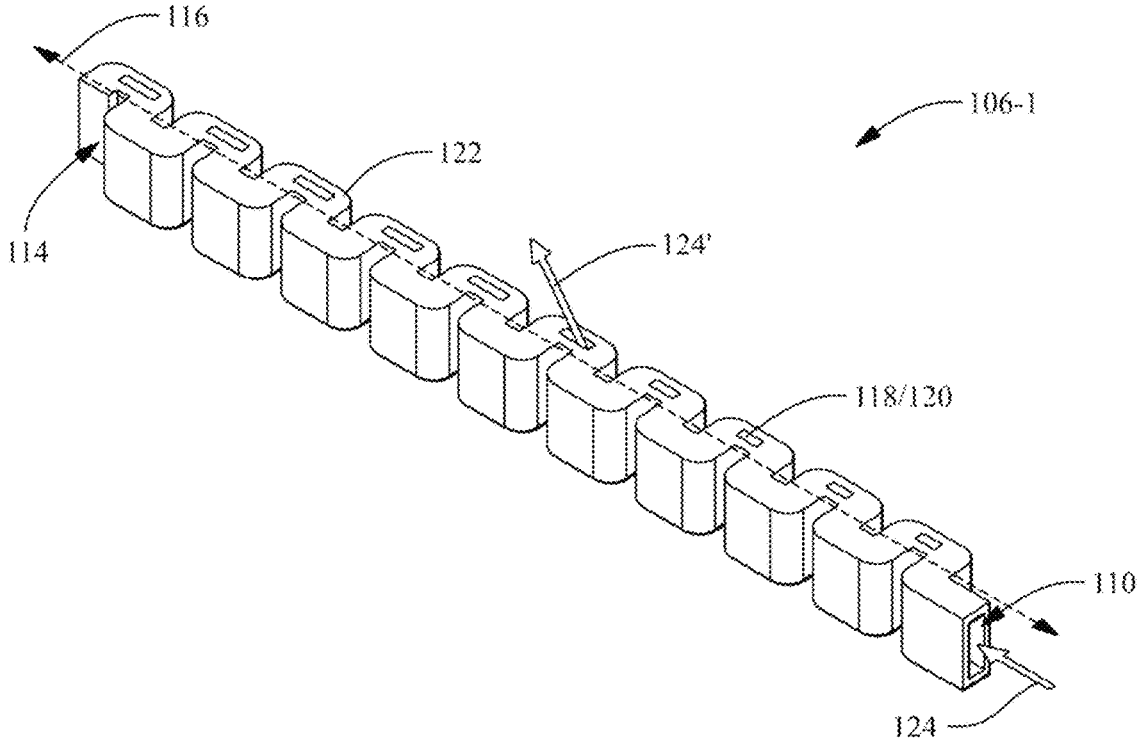
Figure 1:
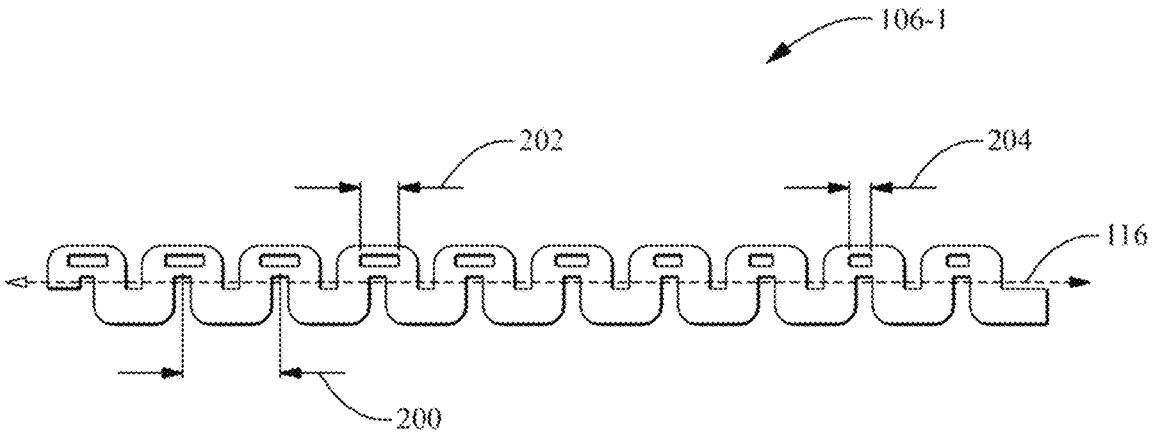
Figure 2:
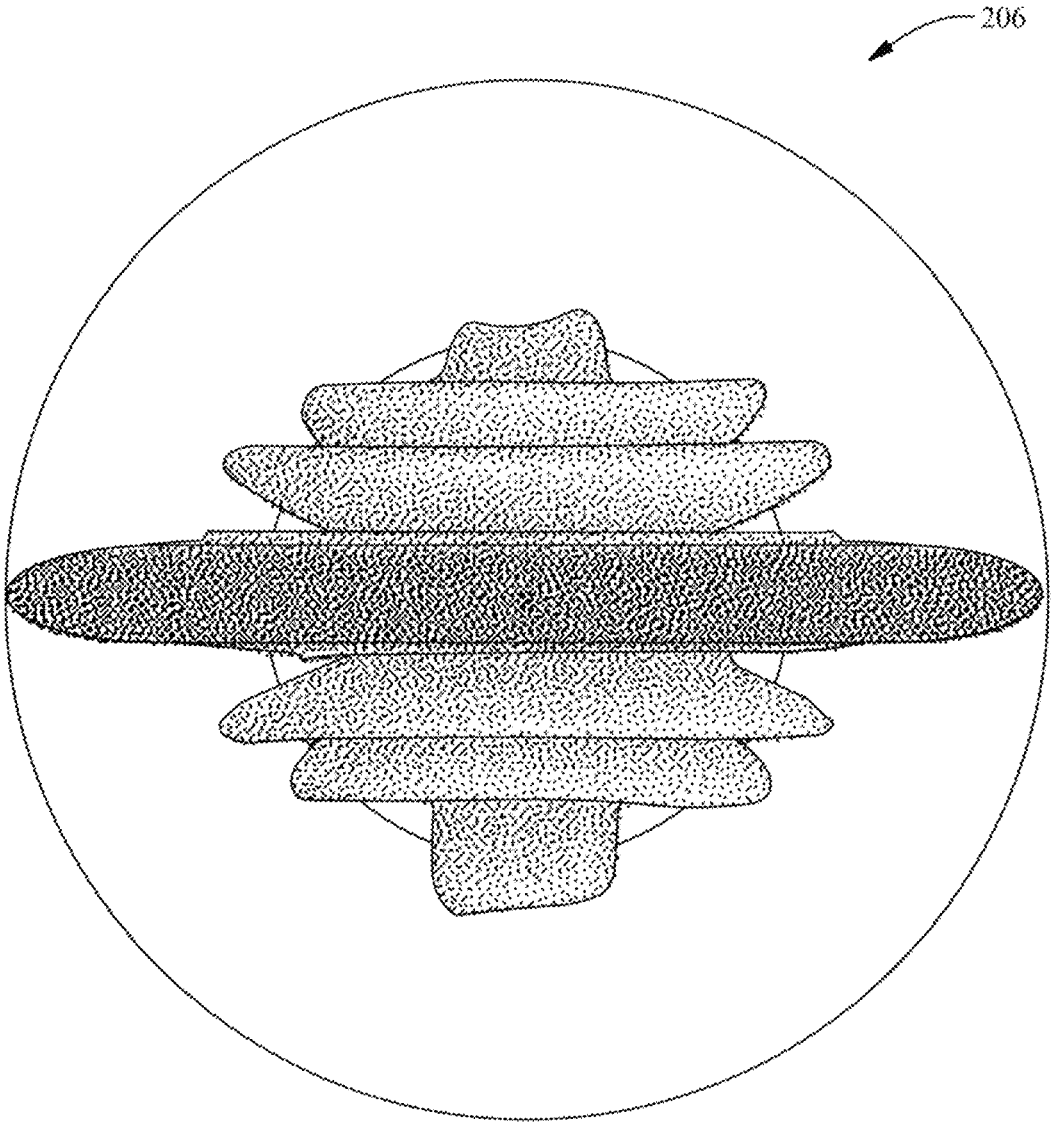

FIG. 2-1 illustrates an example folded waveguide 106-1 for antenna, in accordance with techniques, apparatuses, and systems of this disclosure. The waveguide 106-1 is an example of the waveguide 106. Each radiation slot from the plurality of radiation slots 118 includes a longitudinal slot that is parallel to the longitudinal axis 116 to produce a horizontal-polarized antenna pattern at the antenna element that is electrically coupled to the opposite end of the hollow core.

As shown in FIG. 2-1, the plurality of radiation slots 118 are evenly distributed between the rectangular opening 110 and the closed wall 114, and along the longitudinal axis 116 that runs in the longitudinal direction 112 through the hollow core 108. Each adjacent pair of radiation slots from the plurality of radiation slots 118 includes two radiation slots that are separated along the longitudinal axis 116 by a common distance 200 to produce the particular antenna pattern at the antenna 104 that is electrically coupled to the opposite end of the hollow core 108. The separation by the common distance 200 can prevent grating lobes. The common distance 200 is less than one wavelength of the electromagnetic radiation 124 that reaches the opposite end of the hollow core 108.

Each of the plurality of radiation slots 118 is sized and positioned on the surface 122 to produce a particular antenna pattern. The holes 120 of the plurality of radiation slots 118 have a larger size 202 near the wall 114 at the opposite end of the hollow core 108 and a smaller size 204 near the rectangular opening 110. The specific size and position of the radiation slots 118 can be determined by building and optimizing a model of the waveguide 106 to produce the particular desired antenna pattern. The radiation slots 118 are fed in-phase, hence the reason to be the common distance 200 apart.

FIG. 2-2 illustrates an antenna pattern associated with the example folded waveguide for antenna shown in FIG. 2-1. Because each radiation slot is a longitudinal slot that is parallel to the longitudinal axis 116, the waveguide 106 is tuned to produce a horizontal-polarized antenna pattern 206 at the antenna 104. As shown in FIG. 2-2, the grating lobes can be avoided if the pitch of common distance 200 is less than the electromagnetic radiation 124 wavelength. Elevation of the side lobe can be controlled by changing the size or length of the radiation slots 118.

Figures 2, 3:
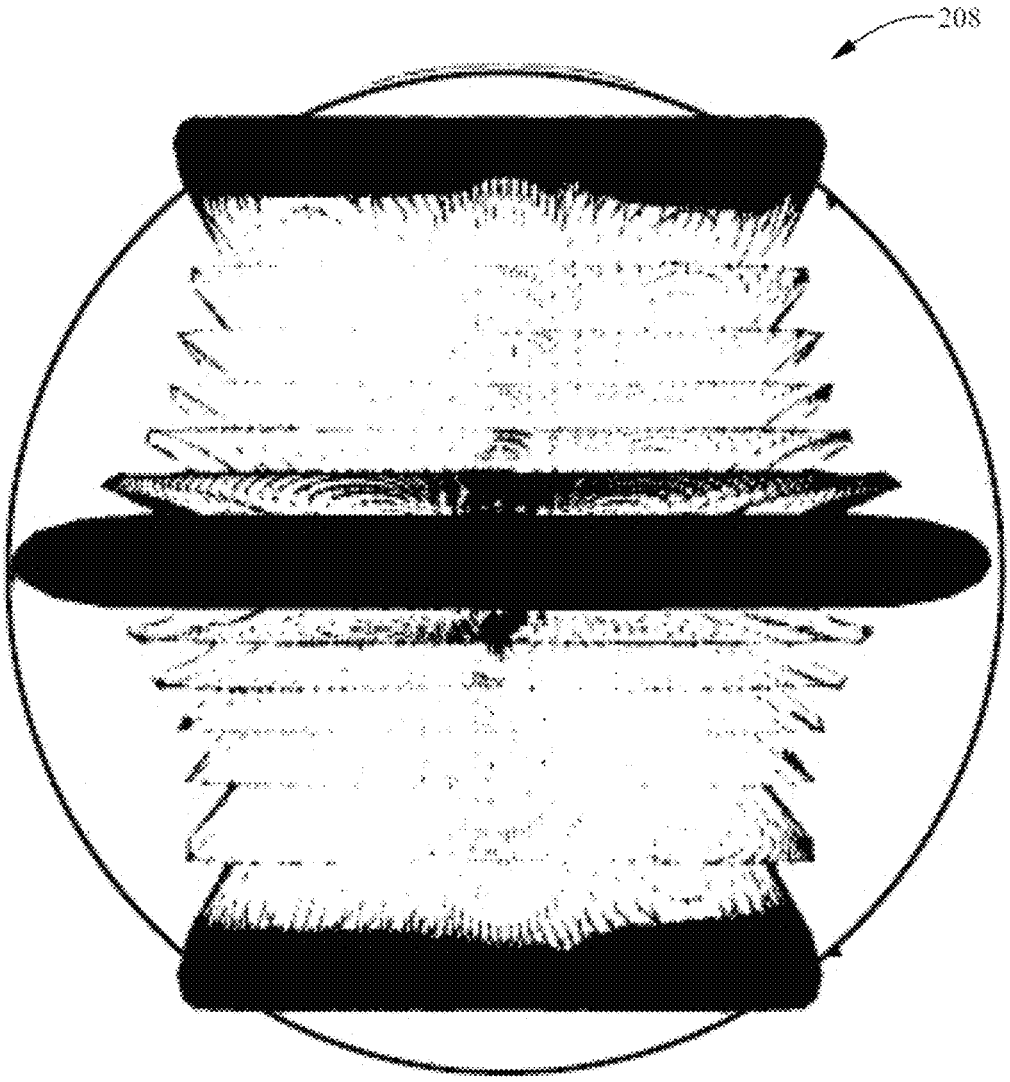
Figure 3:
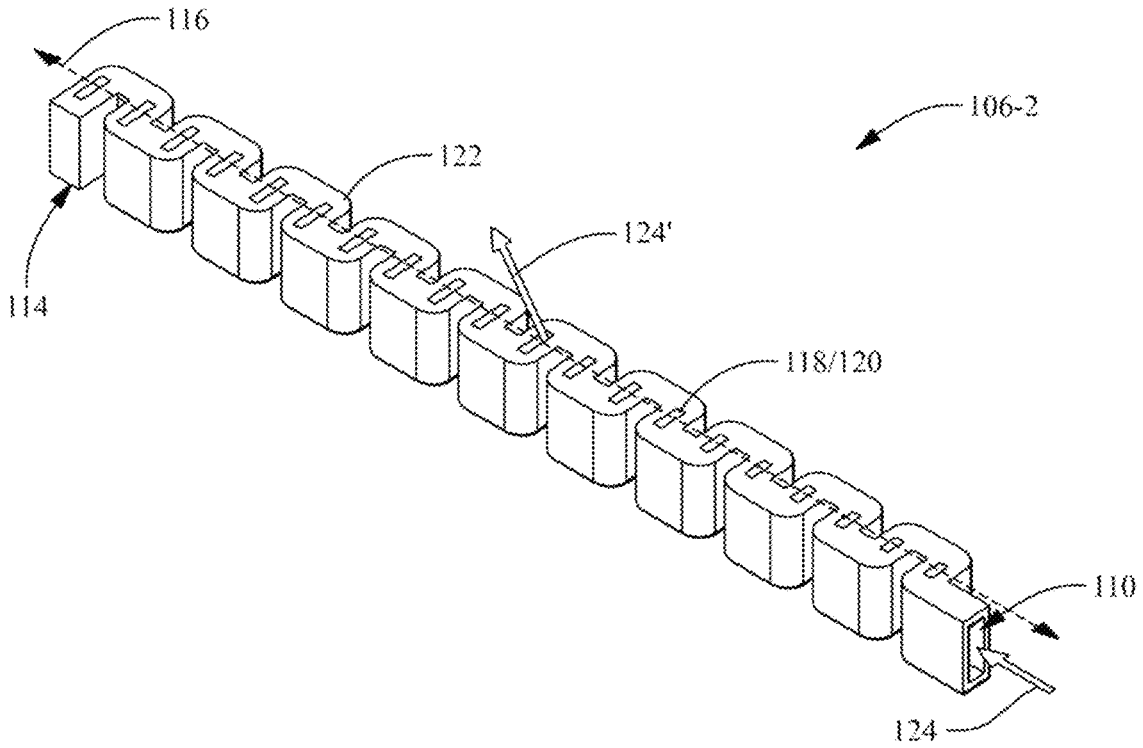
Figure 1:
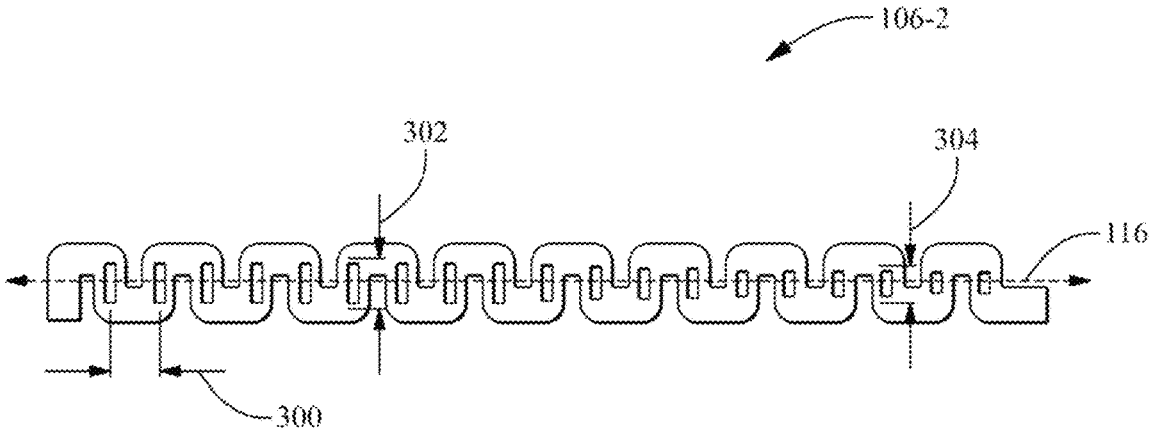
Figures 2, 3:
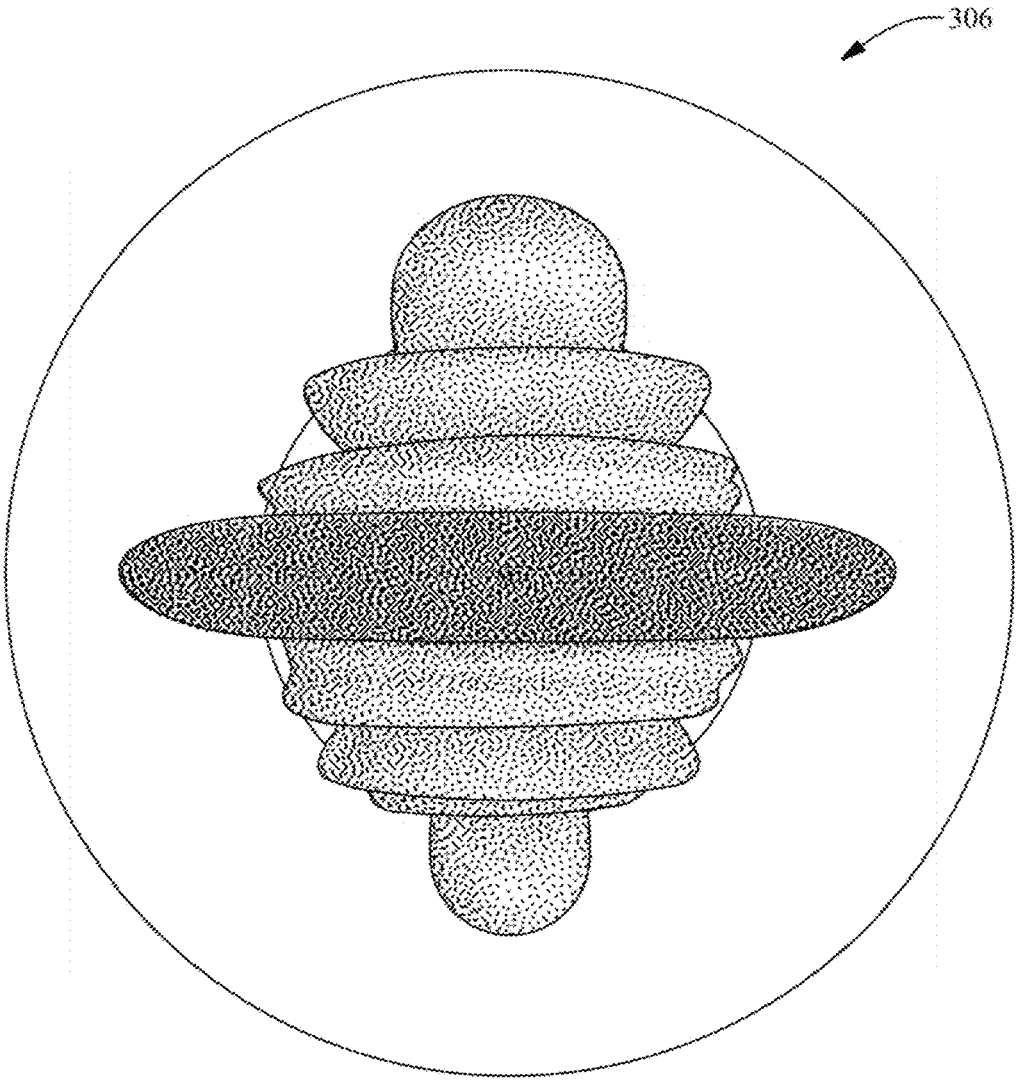
Figure 3:
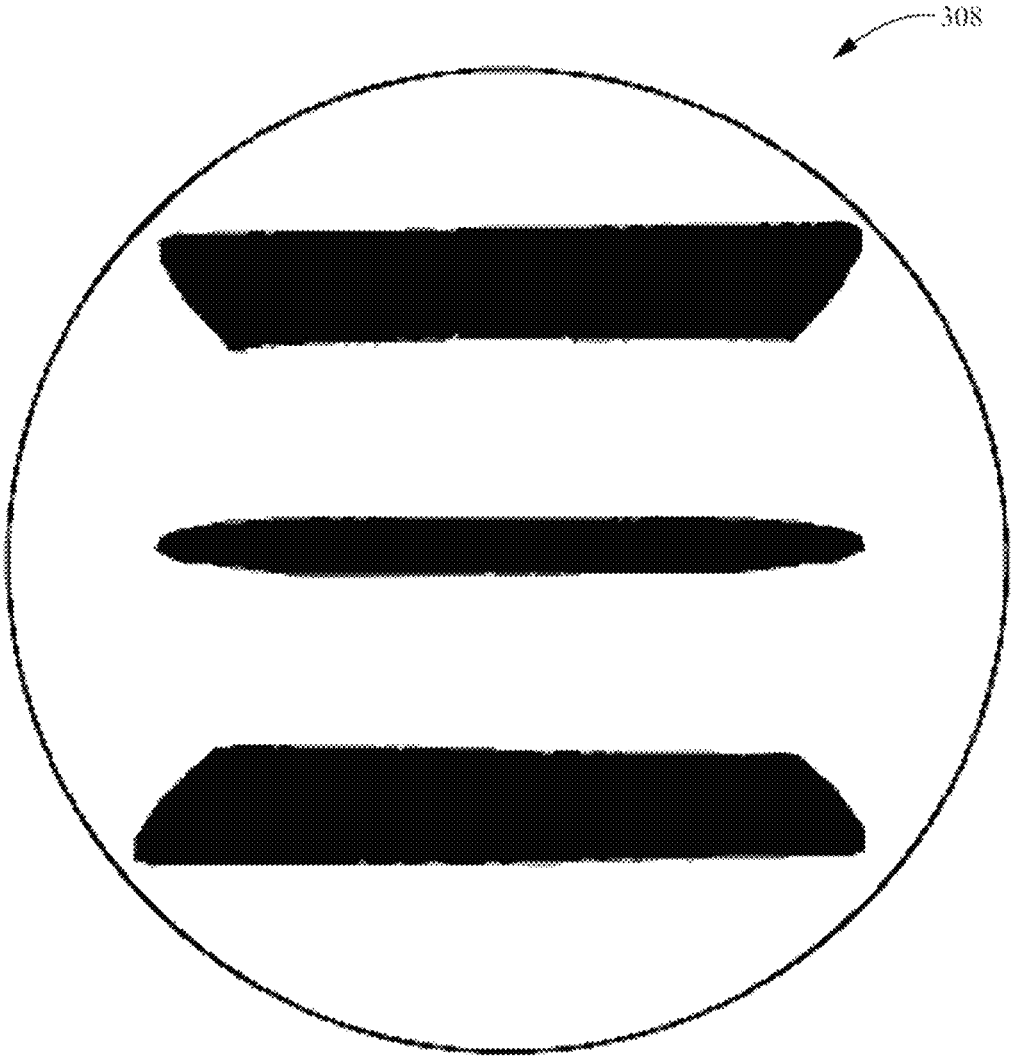

FIG. 2-3 illustrates an antenna pattern 208 without the example folded waveguide for antenna shown in FIG. 2-1. A drawback to such other waveguides includes the grating lobes shown in the antenna pattern 208 that appear on either side of the horizontal-polarity main beam.

FIG. 3-1 illustrates another example folded waveguide 106-2 for antenna, in accordance with techniques, apparatuses, and systems of this disclosure. The waveguide 106-2 is an example of the waveguide 106. Each radiation slot from the plurality of radiation slots 118 includes a lateral slot that is perpendicular to the longitudinal axis 116 to produce a vertical-polarized antenna pattern at the antenna element that is electrically coupled to the opposite end of the hollow core 108.

As shown in FIG. 3-1, the plurality of radiation slots 118 are evenly distributed between the rectangular opening 110 and the closed wall 114, and along the longitudinal axis 116 that runs in the longitudinal direction 112 through the hollow core 108. Each adjacent pair of radiation slots from the plurality of radiation slots 118 includes two radiation slots that are separated along the longitudinal axis 116 by a common distance 300 to produce the particular antenna pattern at the antenna 104 that is electrically coupled to the opposite end of the hollow core 108. The separation by the common distance 300 or pitch can prevent X-band lobes. The common distance 300 is much less than one wavelength of the electromagnetic radiation 124 that reaches the opposite end of the hollow core 108.

Each of the plurality of radiation slots 118 is sized and positioned on the surface 122 to produce a particular antenna pattern. The holes 120 of the plurality of radiation slots 118 have a larger size 302 near the wall 114 at the opposite end of the hollow core 108 and a smaller size 304 near the rectangular opening 110. The specific size and position of the radiation slots 118 can be determined by building and optimizing a model of the waveguide 106 to produce the particular antenna pattern desired.

FIG. 3-2 illustrates an antenna pattern associated with the example folded waveguide for the antenna shown in FIG. 3-1. Because each radiation slot is a lateral slot that is perpendicular to the longitudinal axis 116, the waveguide 106 is tuned to produce a vertical-polarized antenna pattern 306 at the antenna 104. As shown in FIG. 3-2, the X-band lobes can be avoided if the pitch of common distance 300 is less than the electromagnetic radiation 124 wavelength. Elevation of the side lobe can be controlled by changing the size or length of the radiation slots 118.

FIG. 3-3 illustrates an antenna pattern 308 without the example folded waveguide for antenna shown in FIG. 3-1. A drawback to such other waveguides includes the X-band lobes shown in the antenna pattern 308 that appear on either side of the vertical-polarity main beam.

Figure 4:
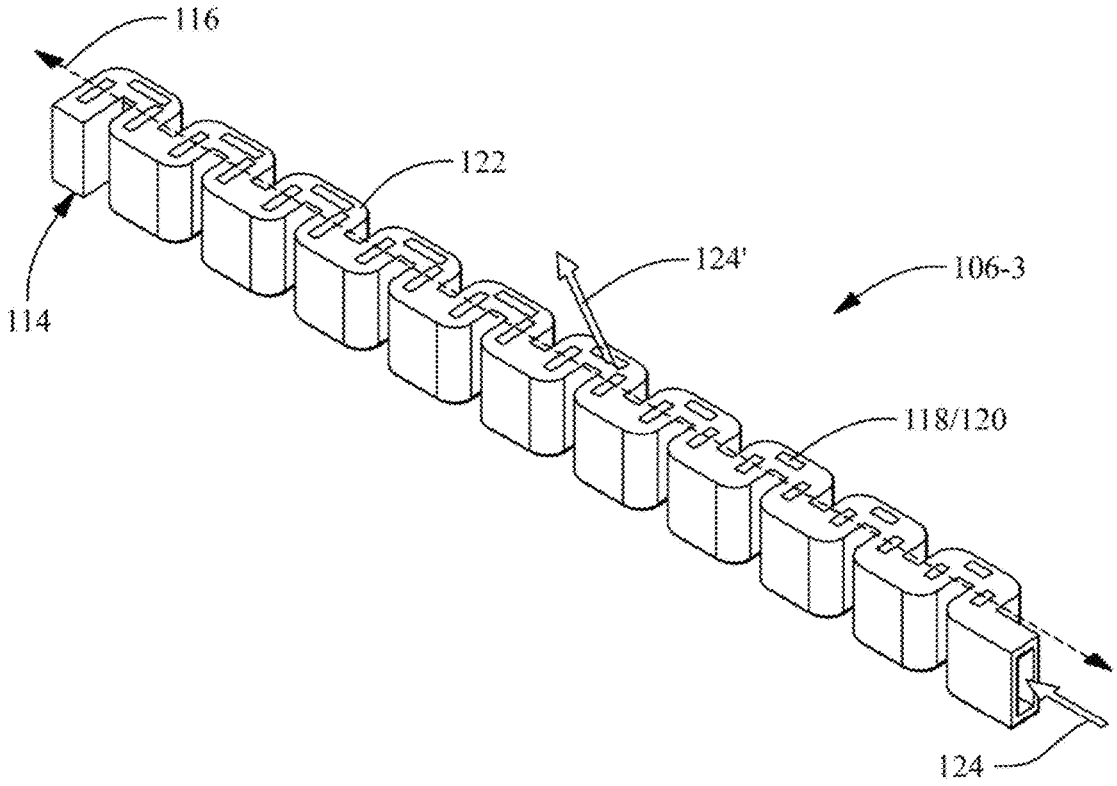
Figure 1:
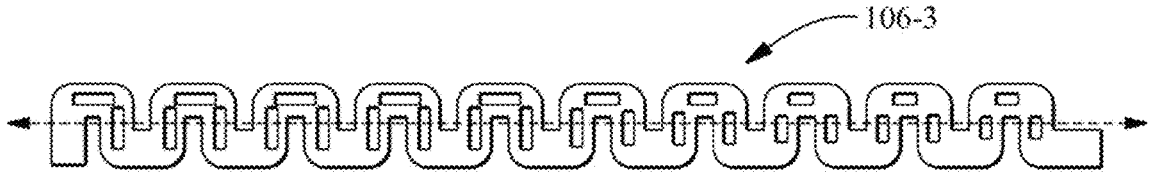
Figures 2, 4:
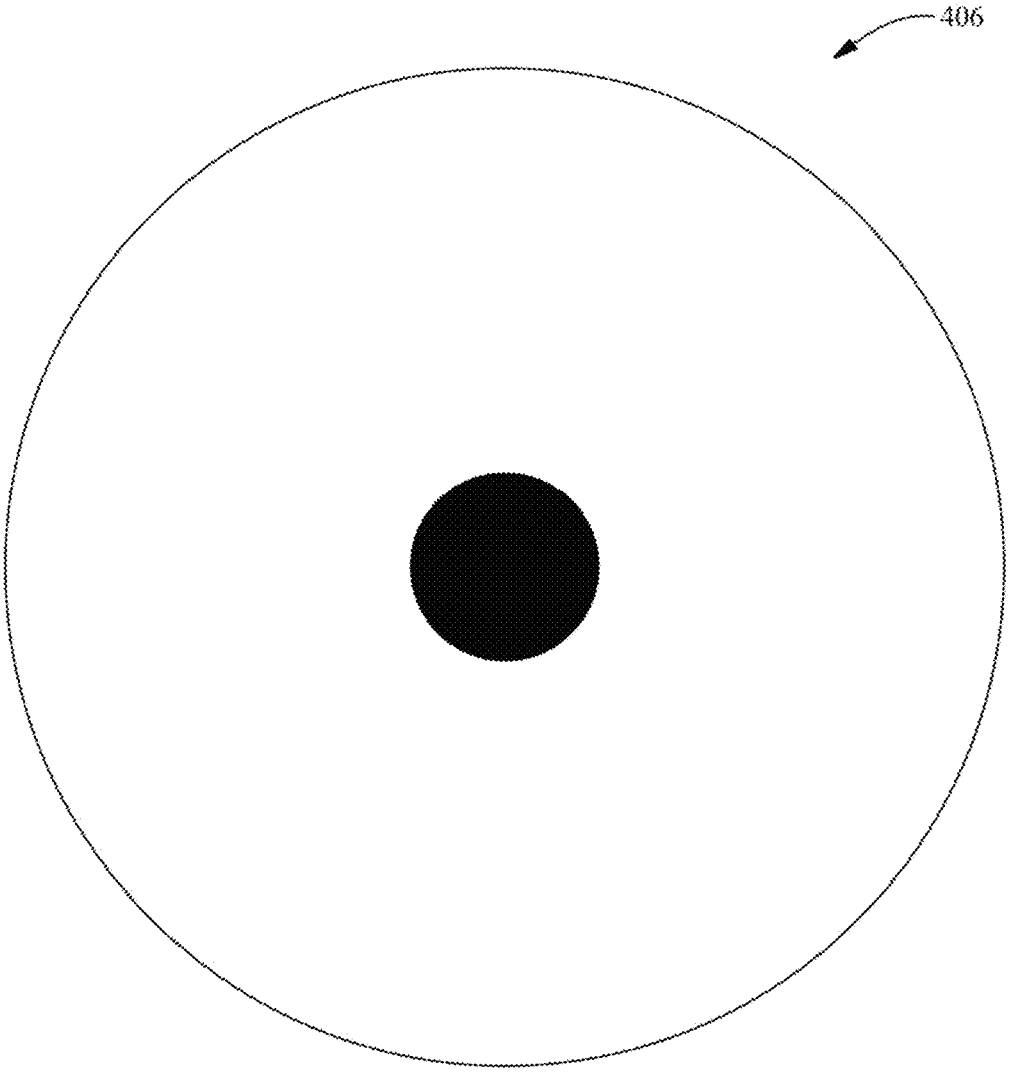

FIG. 4-1 illustrates another example folded waveguide 106-3 for antenna, in accordance with techniques, apparatuses, and systems of this disclosure. FIG. 4-1 represents a combination of the waveguide 106-1 and 106-2 and is therefore an example of the waveguide 106. As shown in FIG. 4-1, a first half of the plurality of radiation slots comprises a longitudinal slot that is parallel to the longitudinal axis, and a second half of the plurality of radiation slots comprises a lateral slot that is perpendicular to the longitudinal axis to produce a circular antenna pattern at the antenna element that is electrically coupled to the opposite end of the hollow core.

FIG. 4-2 illustrates an antenna pattern associated with the example folded waveguide for antenna shown in FIG. 4-1. Because a combination of lateral slots and longitudinal slots are used, the waveguide 106 is tuned to produce a circularly polarized antenna pattern 406 at the antenna 104. As shown in FIG. 4-2, the grating lobes and the X-band lobes can be avoided if the pitch of common distance between radiation slots is less than the electromagnetic radiation 124 wavelength. Elevation of the side lobe can be controlled by changing the size or length of the radiation slots 118.

Figure 5:
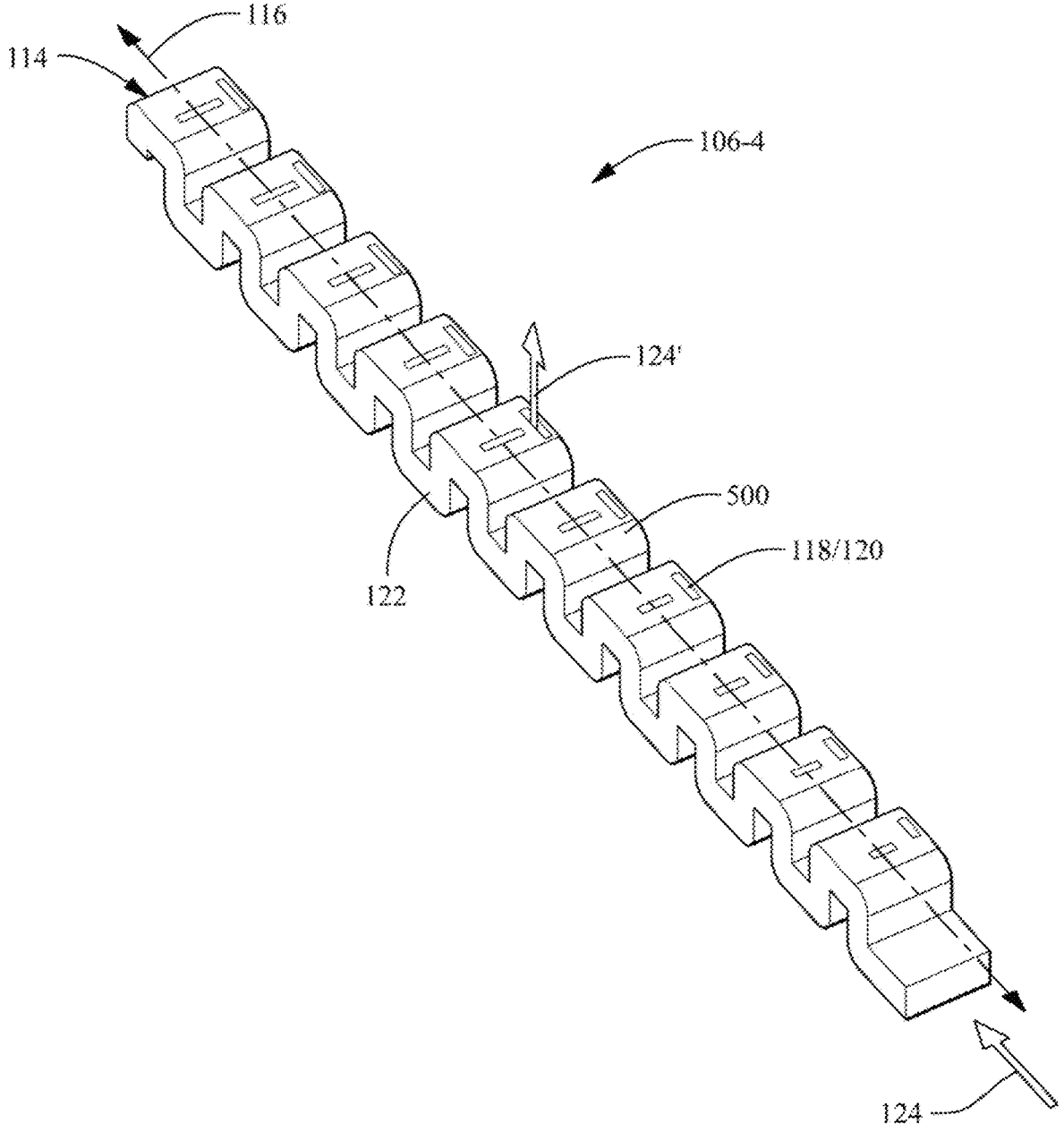
FIG. 5 illustrates another example folded waveguide for antenna, in accordance with techniques, apparatuses, and systems of this disclosure.

FIG. 5 illustrates another example folded waveguide 106-4 for antenna, in accordance with techniques, apparatuses, and systems of this disclosure. FIG. 5 is an example of the waveguide 106, having radiation slots in a different surface 500 than what is illustrated as the surface 122 in FIGS. 1, 2-1, 3-1, and 4-1. The surface 500 is perpendicular to the surface 122, which folds back and forth about the axis 116. As shown in FIG. 5, the plurality of radiation slots 120 comprises a combination of longitudinal slot that are parallel to the longitudinal axis, and lateral slots that are perpendicular to the longitudinal axis, although only longitudinal, or only lateral slots may be used depending on the particular antenna pattern desired. For instance, the combination shown in FIG. 5 produces a circular antenna pattern at the antenna element that is electrically coupled to the opposite end of the hollow core. If only longitudinal slots are used, a horizontal-polarity antenna pattern is produced. If only lateral slots are used, a vertical-polarity antenna pattern is produced.

Example Method

Figure 6:
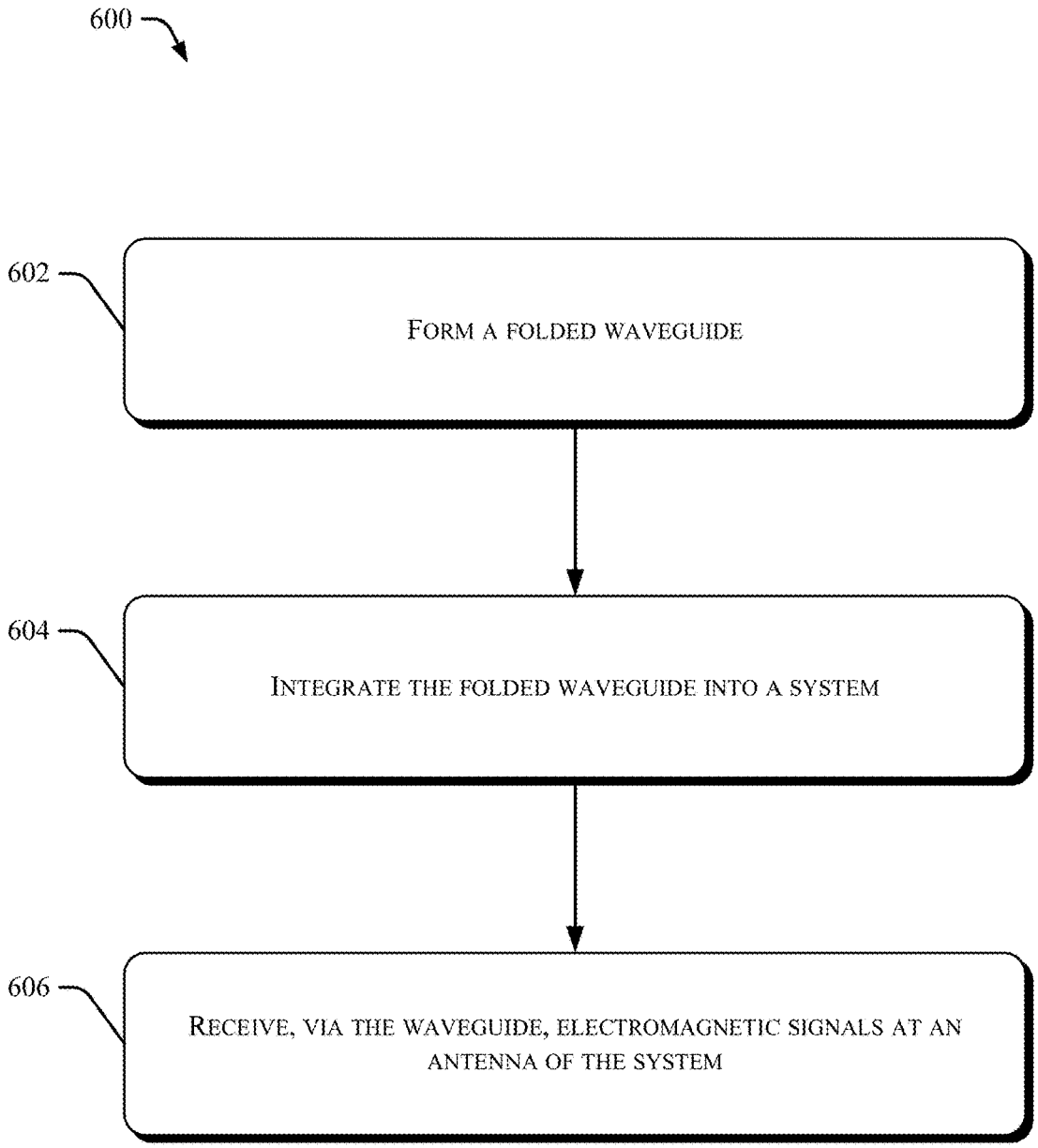
FIG. 6 depicts an example method that can be used for manufacturing a folded waveguide for antenna, in accordance with techniques, apparatuses, and systems of this disclosure.

FIG. 6 depicts an example method that can be used for manufacturing a folded waveguide for antenna, in accordance with techniques, apparatuses, and systems of this disclosure. The process 600 is shown as a set of operations 602 through 606, which are performed in, but not limited to, the order or combinations in which the operations are shown or described. Further, any of the operations 602 through 606 may be repeated, combined, or reorganized to provide other methods. In portions of the following discussion, reference may be made to the environment 100 and entities detailed in above, reference to which is made for example only. The techniques are not limited to performance by one entity or multiple entities.

At 602, a folded waveguide for antenna is formed. For example, the waveguide 106 can be stamped, etched, cut, machined, cast, molded, or formed in some other way. At 604, the folded waveguide is integrated into a system. For example, the waveguide 106 is electrically coupled to the antenna 104. At 606, electromagnetic signals are received via the waveguide at an antenna of the system. For example, the device 102 receives signals captured from air by the waveguide 106 and routed through the antenna 104.

Additional Examples

In the following section, additional examples of a folded waveguide for antenna are provided.

Example 1. An apparatus, the apparatus comprising: a folded waveguide comprising a hollow core, the hollow core forming: a rectangular opening in a longitudinal direction at one end; a closed wall at an opposite end; a sinusoidal shape that folds back and forth about a longitudinal axis that runs in the longitudinal direction through the hollow core; and a plurality of radiation slots, each of the radiation slots comprising a hole through one of multiple surfaces of the folded waveguide that defines the hollow core, the plurality of radiation slots being arranged on the one of the multiple surfaces to produce a particular antenna pattern for a device and an antenna element that is electrically coupled to the opposite end of the hollow core.

Example 2. The apparatus of any preceding example, wherein each of the plurality of radiation slots is configured to dissipate, from the hollow core, a portion of electromagnetic radiation that enters the rectangular opening before that portion of the electromagnetic radiation can reach the antenna element that is electrically coupled to the opposite end of the hollow core.

Example 3. The apparatus of any preceding example, wherein each of the plurality of radiation slots is sized and positioned on the one of the multiple surfaces to produce the particular antenna pattern at the antenna element that is electrically coupled to the opposite end of the hollow core.

Example 4. The apparatus of any preceding example, wherein the plurality of radiation slots is evenly distributed between the rectangular opening and the closed wall, and along the longitudinal axis that runs in the longitudinal direction through the hollow core.

Example 5. The apparatus of any preceding example, wherein each adjacent pair of radiation slots from the plurality of radiation slots comprises two radiation slots that are separated along the longitudinal axis by a common distance to produce the particular antenna pattern at the antenna element that is electrically coupled to the opposite end of the hollow core.

Example 6. The apparatus of any preceding example, wherein the common distance is less than one wavelength of electromagnetic radiation that reaches the hollow core.

Example 7. The apparatus of any preceding example, wherein each adjacent pair of radiation slots from the plurality of radiation slots comprises two radiation slots that are separated along the longitudinal axis by a common distance to prevent grating lobes or X-band lobes within the particular antenna pattern.

Example 8. The apparatus of any preceding example, wherein each radiation slot from the plurality of radiation slots comprises a lateral slot that is perpendicular to the longitudinal axis to produce a vertical-polarized antenna pattern at the antenna element that is electrically coupled to the opposite end of the hollow core.

Example 9. The apparatus of any preceding example, wherein each radiation slot from the plurality of radiation slots comprises a longitudinal slot that is parallel to the longitudinal axis to produce a horizontal-polarized antenna pattern at the antenna element that is electrically coupled to the opposite end of the hollow core.

Example 10. The apparatus of any preceding example, wherein a first half of the plurality of radiation slots comprises a longitudinal slot that is parallel to the longitudinal axis, and a second half of the plurality of radiation slots comprises a lateral slot that is perpendicular to the longitudinal axis to produce a circularly polarized antenna pattern at the antenna element that is electrically coupled to the opposite end of the hollow core.

Example 11. The apparatus of any preceding example, wherein the folded waveguide comprises metal.

Example 12. The apparatus of any preceding example, wherein the folded waveguide comprises plastic.

Example 13. A system, the system comprising: an antenna element; a device configured to transmit or receive electromagnetic signals via the antenna; and a folded waveguide comprising: a hollow core forming: a rectangular opening in a longitudinal direction at one end; a closed wall at an opposite end that is electrically coupled to the antenna element; a sinusoidal shape that folds back and forth about a longitudinal axis that runs in the longitudinal direction through the hollow core; and a plurality of radiation slots, each of the radiation slots comprising a hole through one of multiple surfaces of the folded waveguide that defines the hollow core, the plurality of radiation slots being arranged on the one of the multiple surfaces to produce a particular antenna pattern at the antenna element.

Example 14. The system of any preceding example, wherein the device comprises a radar device.

Example 15. The system of any preceding example, further comprising a vehicle comprising the antenna element, the device, and the folded waveguide.

Example 16. The system of any preceding example, wherein each of the plurality of radiation slots is configured to dissipate, from the hollow core, a portion of electromagnetic radiation that enters the rectangular opening before that portion of the electromagnetic radiation can reach the antenna element that is electrically coupled to the opposite end of the hollow core.

Example 17. The system of any preceding example, wherein each of the plurality of radiation slots is sized and positioned on the one of the multiple surfaces to produce the particular antenna pattern at the antenna element that is electrically coupled to the opposite end of the hollow core.

Example 18. The system of any preceding example, wherein each radiation slot from the plurality of radiation slots comprises a lateral slot that is perpendicular to the longitudinal axis to produce a horizontal-polarized antenna pattern at the antenna element that is electrically coupled to the opposite end of the hollow core; wherein each radiation slot from the plurality of radiation slots comprises a longitudinal slot that is parallel to the longitudinal axis to produce a vertical-polarized antenna pattern at the antenna element that is electrically coupled to the opposite end of the hollow core; or wherein a first portion of the plurality of radiation slots comprises a longitudinal slot that is parallel to the longitudinal axis, and a second portion of the plurality of radiation slots comprises a lateral slot that is perpendicular to the longitudinal axis to produce a circularly polarized antenna pattern at the antenna element that is electrically coupled to the opposite end of the hollow core.

Example 19. The system of any preceding example, wherein each of the plurality of radiation slots comprises a hole through a particular surface of the multiple surfaces, the particular surface being one of two surfaces that folds back and forth about the longitudinal axis that runs in the longitudinal direction through the hollow core.

Example 20. The system of any preceding example, wherein each of the plurality of radiation slots comprises a hole through a particular surface of the multiple surfaces, the particular surface being one of two surfaces that is perpendicular to two other surfaces that fold back and forth about the longitudinal axis that runs in the longitudinal direction through the hollow core.

Conclusion

While various embodiments of the disclosure are described in the foregoing description and shown in the drawings, it is to be understood that this disclosure is not limited thereto but may be variously embodied to practice within the scope of the following claims. From the foregoing description, it will be apparent that various changes may be made without departing from the spirit and scope of the disclosure as defined by the following claims.

The use of "or" and grammatically related terms indicates non-exclusive alternatives without limitation unless the context clearly dictates otherwise. As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

What is claimed is:

1. An apparatus, the apparatus comprising:

a folded waveguide comprising a hollow core for air, the hollow core forming a sinusoidal shape that folds back and forth about a longitudinal axis that runs in a longitudinal direction through the hollow core; and a plurality of radiation slots, each of the radiation slots comprising a hole through one of multiple surfaces of the folded waveguide that defines the hollow core, the plurality of radiation slots being arranged on the one of the multiple surfaces to produce a particular antenna pattern at an antenna element that is electrically coupled to the air in the hollow core.

2. The apparatus of claim 1, wherein each of the plurality of radiation slots is configured to dissipate, from the hollow core, a portion of electromagnetic radiation that enters the hollow core before that portion of the electromagnetic radiation can reach the antenna element.

3. The apparatus of claim 1, wherein each of the plurality of radiation slots is sized and positioned on the one of the multiple surfaces to produce the particular antenna pattern at the antenna element.

4. The apparatus of claim 3, wherein the plurality of radiation slots is evenly distributed along the longitudinal axis.

5. The apparatus of claim 4, wherein each adjacent pair of radiation slots from the plurality of radiation slots comprises two radiation slots that are separated along the longitudinal axis by a common distance to produce the particular antenna pattern at the antenna element.

6. The apparatus of claim 5, wherein the common distance is less than one wavelength of electromagnetic radiation that reaches the opposite end of the hollow core.

7. The apparatus of claim 4, wherein each adjacent pair of radiation slots from the plurality of radiation slots comprises two radiation slots that are separated along the longitudinal axis by a common distance to prevent grating lobes or X-band lobes within the particular antenna pattern.

8. The apparatus of claim 1, wherein each radiation slot from the plurality of radiation slots comprises a lateral slot that is perpendicular to the longitudinal axis to produce a horizontal-polarized antenna pattern at the antenna element.

9. The apparatus of claim 1, wherein each radiation slot from the plurality of radiation slots comprises a longitudinal slot that is parallel to the longitudinal axis to produce a vertical-polarized antenna pattern at the antenna element.

10. The apparatus of claim 1, wherein a first half of the plurality of radiation slots comprises a longitudinal slot that is parallel to the longitudinal axis, and a second half of the plurality of radiation slots comprises a lateral slot that is perpendicular to the longitudinal axis to produce a circularly polarized antenna pattern at the antenna element.

11. The apparatus of claim 1, wherein the multiple surfaces comprise surfaces of one or more molded metal parts.

12. The apparatus of claim 1, wherein the multiple surfaces comprise surfaces of one or more metallized plastic parts.

13. A system, the system comprising:

an antenna element; and a folded waveguide comprising:

a hollow core for air that is electrically coupled to the antenna element, the folded waveguide forming a sinusoidal shape that folds back and forth about a longitudinal axis that runs in a longitudinal direction through the hollow core; and a plurality of radiation slots, each of the radiation slots comprising a hole through one of multiple surfaces of the folded waveguide that defines the hollow core, the plurality of radiation slots being arranged on the one of the multiple surfaces to produce a particular antenna pattern at the antenna element.

14. The system of claim 13, wherein the system further comprises a device configured to transmit or receive electromagnetic signals via the antenna element.

15. The system of claim 14, wherein the system comprises a radar device.

16. The system of claim 13, wherein each of the plurality of radiation slots is configured to dissipate, from the hollow core, a portion of electromagnetic radiation within the air before that portion of the electromagnetic radiation can reach the antenna element.

17. The system of claim 13, wherein each of the plurality of radiation slots is sized and positioned on the one of the multiple surfaces to produce the particular antenna pattern at the antenna element.

18. The system of claim 13, wherein at least one of:

a first slot of the plurality of radiation slots comprises a lateral slot that is perpendicular to the longitudinal axis to produce a first-polarized antenna pattern at the antenna element; or a second slot of the plurality of radiation slots comprises a longitudinal slot that is parallel to the longitudinal axis to produce a second-polarized antenna pattern at the antenna element.

19. The system of claim 13, wherein at least one of:

at least one first slot of the plurality of radiation slots comprises a lateral slot that is perpendicular to the longitudinal axis and at least one second slot of the plurality of radiation slots comprises a longitudinal slot that is parallel to the longitudinal axis to produce a circularly polarized antenna pattern at the antenna element.

20. The system of claim 13, wherein each of the plurality of radiation slots comprises a hole through a particular surface of the multiple surfaces, wherein:

the particular surface is one of two surfaces that folds back and forth about the longitudinal axis; or the particular surface is one of two other surfaces that is perpendicular to the two surfaces that fold back and forth about the longitudinal axis.

* * * * *